US010135175B2

(12) United States Patent
Aoshima

(10) Patent No.: US 10,135,175 B2
(45) Date of Patent: Nov. 20, 2018

(54) WATER STOP STRUCTURE OF SHIELD CONNECTOR

(71) Applicant: Yazaki Corporation, Tokyo (JP)

(72) Inventor: Kengo Aoshima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/704,971

(22) Filed: Sep. 14, 2017

(65) Prior Publication Data

US 2018/0090872 A1 Mar. 29, 2018

(30) Foreign Application Priority Data

Sep. 26, 2016 (JP) ..... 2016-187115

(51) Int. Cl.

*H01R 13/40* (2006.01)
*H01R 13/52* (2006.01)
*H01R 13/02* (2006.01)
*H01R 13/648* (2006.01)

(52) U.S. Cl.

CPC ..... *H01R 13/5202* (2013.01); *H01R 13/025* (2013.01); *H01R 13/5205* (2013.01); *H01R 13/5216* (2013.01); *H01R 13/648* (2013.01); *H01R 13/6485* (2013.01)

(58) Field of Classification Search

CPC ..... H01R 13/6485; H01R 13/025; H01R 13/5202
USPC ..... 439/607.01, 98, 587, 559
See application file for complete search history.

(56) References Cited

U.S. PATENT DOCUMENTS 5,874,707 A * 2/1999 Iida ..... H05H 1/34 219/121.36
6,019,615 A * 2/2000 Masuda ..... H01R 9/0518 174/653
6,280,208 B1 * 8/2001 Masuda ..... H01R 4/64 174/359
6,669,511 B1 * 12/2003 Yagi ..... H01R 4/646 439/607.44
6,674,005 B2 * 1/2004 Yagi ..... H01R 9/032 138/123
7,195,504 B2 * 3/2007 Bertini ..... H01R 13/523 439/201
8,241,062 B2 * 8/2012 Tsuruta ..... H01R 9/032 439/352

(Continued)

FOREIGN PATENT DOCUMENTS

JP 2016-32387 A 3/2016

*Primary Examiner* — Abdullah Riyami
*Assistant Examiner* — Nelson R Burgos-Guntin
(74) *Attorney, Agent, or Firm* — Kenealy Vaidya LLP

(57) ABSTRACT

In a water stop structure of a shield connector, a rear holder includes a main body disposed at a position facing the inner circumferential surface of the end portion of a shield shell in the connector extraction direction, and a protrusion formed to protrude from the main body along the electric wire in the connector extraction direction between the electric wire and the braided body. The braided body is disposed to cover the outer circumferential surface of the protrusion such that the end portion in the connector insertion direction reaches the connecting part. The tape is wrapped around the braided body in a spiral shape to cover at least the portion from the end portion of the rear holder in the connector extraction direction to the connecting part.

3 Claims, 2 Drawing Sheets

(56) References Cited

U.S. PATENT DOCUMENTS

| | | | | |
|---|---|---|---|---|
| 8,257,101 | B2 * | 9/2012 | Ichio | H01R 13/4367<br>439/206 |
| 9,748,704 | B2 * | 8/2017 | Wang | H01R 13/5205 |
| 9,758,113 | B2 * | 9/2017 | Adachi | B60R 16/0215 |
| 9,862,337 | B2 * | 1/2018 | Inao | B60R 16/0215 |
| 2015/0340801 | A1 * | 11/2015 | Tashiro | H01R 13/506<br>439/587 |
| 2018/0076561 | A1 * | 3/2018 | Aoshima | H01R 13/5202 |

* cited by examiner

WATER STOP STRUCTURE OF SHIELD CONNECTOR

CROSS-REFERENCE TO RELATED APPLICATION(S)

The present application claims priority to and incorporates by reference the entire contents of Japanese Patent Application No. 2016-187115 filed in Japan on Sep. 26, 2016.

BACKGROUND OF THE INVENTION

1. Field of the Invention

The present invention relates to a water stop structure of a shield connector.

2. Description of the Related Art

Conventionally, in a shield connector, by providing a metallic cylindrical shield shell in a housing made of synthetic resin, noise radiated from terminals or electric wires housed inside the shield shell can be confined inside the shield shell. An electric wire housed inside the shield shell is covered with a braided body braided in a tubular shape with metal or the like. The braided body is electrically connected to the shield shell inside the shield connector.

Meanwhile, in the shield connector, for example, a boot made of rubber is assembled as a water stop structure at an outlet portion of the electric wire (see Japanese Patent Application Laid-open No. 2016-32387).

However, in the aforementioned shield connector, when assembling the boot made of rubber serving as a water blocking member, since it is necessary to perform an operation of expanding the opening portion of the boot made of rubber, there is room for improvement in assembling workability.

SUMMARY OF THE INVENTION

An object of the present invention is to provide a water stop structure of a shield connector that improves the assembling workability of the water blocking member.

In order to achieve the above mentioned object, a water stop structure of a shield connector according to one aspect of the present invention includes at least one electric wire to which a terminal is crimped at one end; an electric wire holding member configured to hold the electric wire in an inserted state; a housing made of an insulating material configured to hold the electric wire including the terminal on an inner side and lock the electric wire holding member at an end portion in a connector insertion direction; a tubular shield shell in which a part of the electric wire including the terminal is accommodated on an inner side, a part of the shield shell on the connector insertion direction side is embedded in the housing, and a part of the electric wire holding member is accommodated on an inner circumferential side in a connector extraction direction opposite to the connector insertion direction; a tubular braided body in which a part of the electric wire including the terminal is accommodated on an inner side and which is electrically connected to the shield shell; a shield ring configured to fix a connecting part, in which the shield shell and the braided body are connected to each other, from an outer circumferential side in a diameter reduction direction; and a water blocking member which prevents entry of water to the inner side of the housing and the shield shell, wherein the electric wire holding member includes: a main body disposed at a position facing the inner circumferential surface of the end portion of the shield shell in the connector extraction direction, and a protrusion formed to protrude from the main body along the electric wire in the connector extraction direction between the electric wire and the braided body, the braided body is disposed to cover the outer circumferential surface of the protrusion, such that the end portion of the braided body in the connector insertion direction reaches the connecting part, and the water blocking member is wrapped around the braided body in a spiral shape to cover at least from the end portion of the protrusion in the connector extraction direction to the connecting part.

According to another aspect of the present invention, in the water stop structure of the shield connector, it is preferable that the electric wire holding member further has an inclined surface which is inclined to extend from the end portion of the protrusion in the connector extraction direction toward the connector insertion direction, as the outer circumferential surface of the protrusion.

According to still another aspect of the present invention, in the water stop structure of the shield connector, it is preferable that the electric wire holding member is formed such that the end portion of the main body in the connector extraction direction is located on diameter reduction side than the end portion of the inclined surface in the connector insertion direction, and the shield ring is disposed on the connector insertion direction side than the end portion of the inclined surface in the connector insertion direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a water stop structure of a shield connector according to the present invention will be described in detail with reference to the drawings. The present invention is not limited by the following embodiments. Further, the constituent elements in the following embodiments include so-called elements easily substitutable by those skilled in the art, or substantially the same elements. Further, various omissions, substitutions, and changes can be made to the constituent elements in the embodiments below within the scope that does not depart from the gist of the invention.

Embodiment

Figure 1:
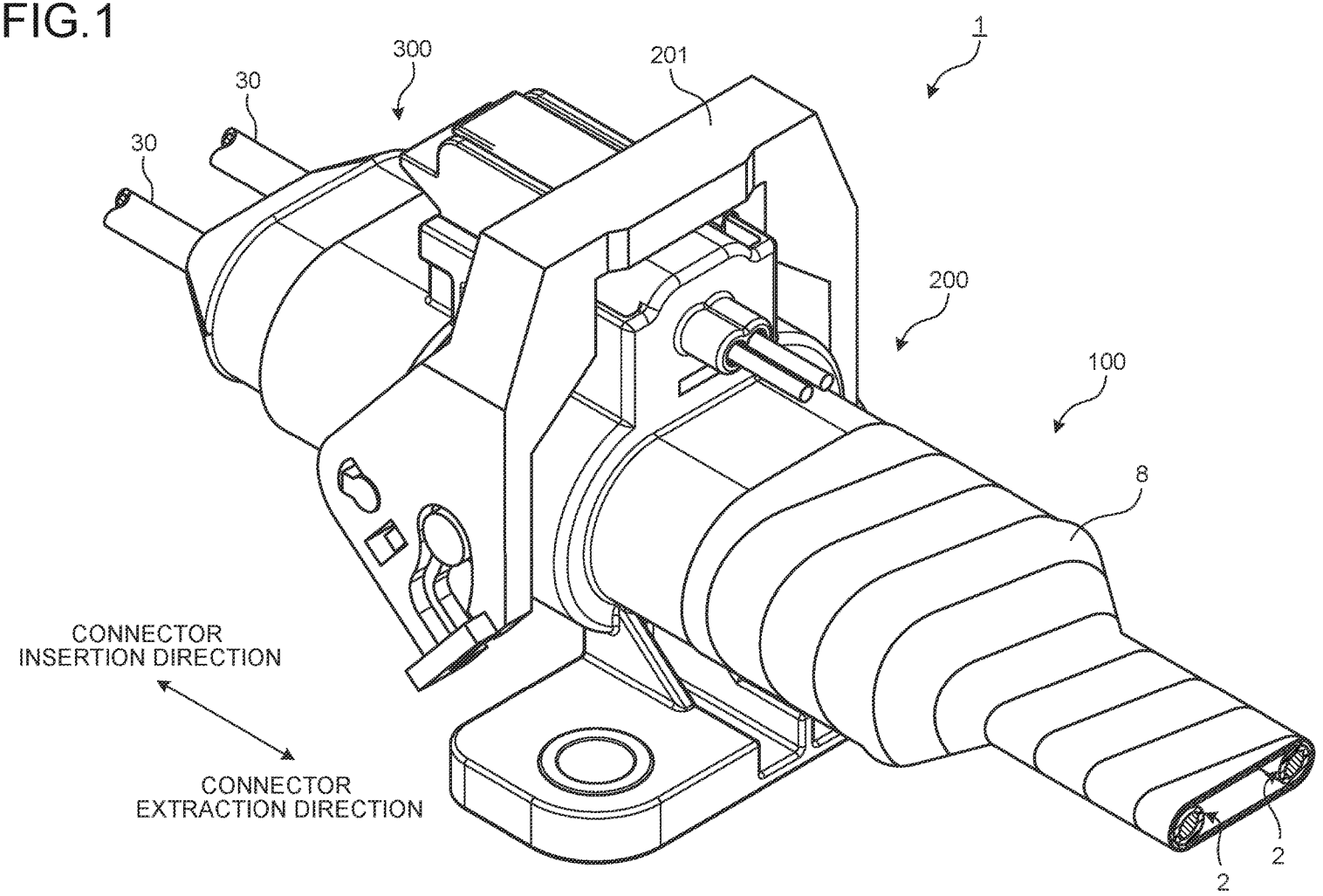
FIG. 1 is a perspective view illustrating an external shape of a water stop structure of a shield connector according to an embodiment.
Figure 2:
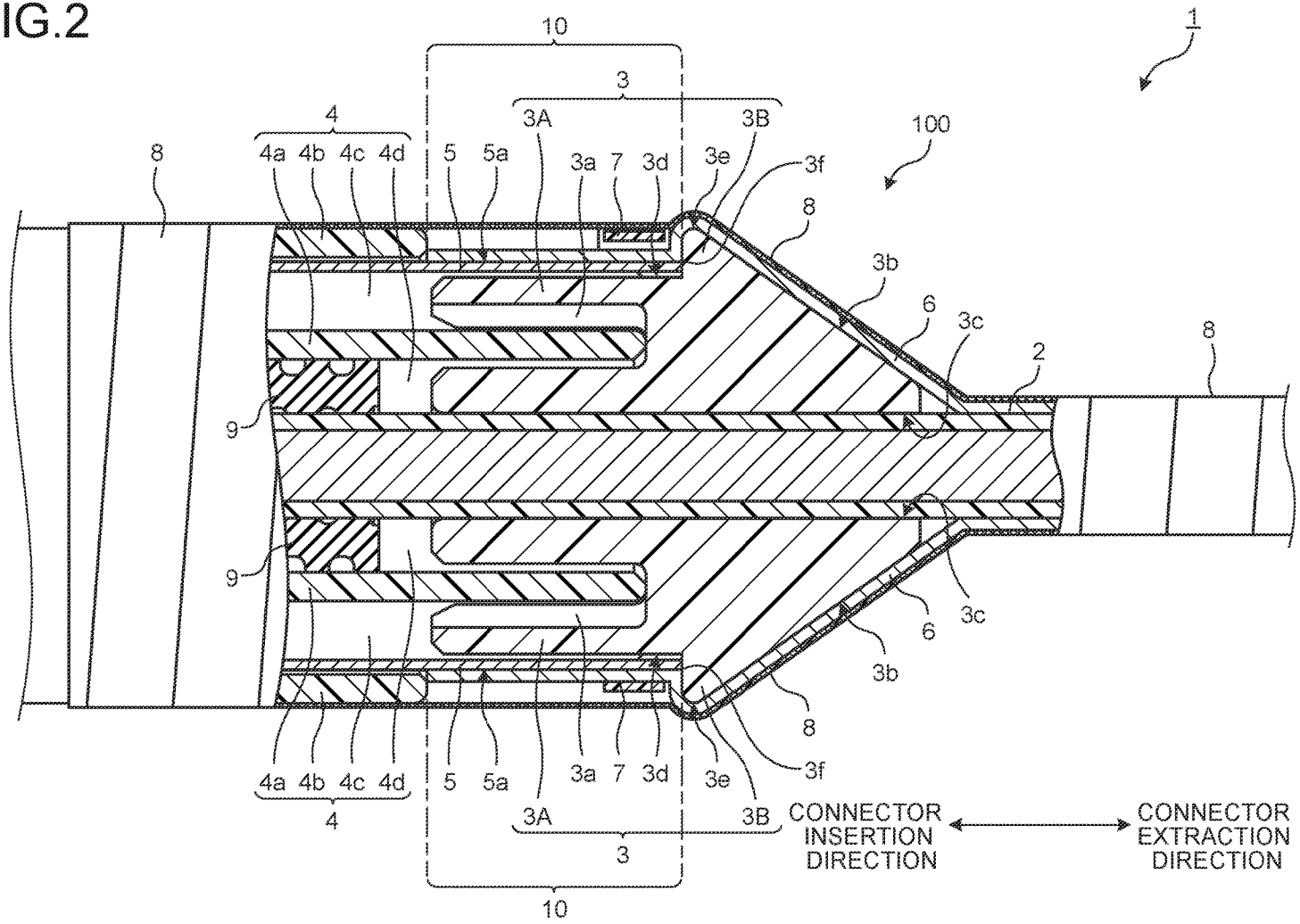
FIG. 2 is a partial cross-sectional view illustrating a schematic configuration of the water stop structure of the shield connector according to an embodiment.

With reference to FIGS. 1 and 2, a water stop structure of a shield connector according to an embodiment will be described. FIG. 1 is a perspective view illustrating an external shape of a water stop structure of a shield connector according to an embodiment. FIG. 2 is a partial cross-sectional view illustrating the schematic configuration of the water stop structure of the shield connector according to the embodiment. Further, FIG. 1 illustrates a state in which a male connector constituting the shield connector is inserted into a female connector.

A shield connector 1 illustrated in FIGS. 1 and 2 is a connector which is mounted on a vehicle such as an automobile to electrically connect the shielded electric wires each other or the shielded electric wires and a device. In the shield connector 1, a water stop structure 100 for preventing water from entering into the housing is applied. The shield connector 1 includes a male connector 200 and a female connector 300, and by rotating a lever 201 of the male connector 200, it is possible to insert or extract the male connector 200 and the female connector 300 with a low operating force. In the water stop structure 100 of the shield connector 1 according to the present embodiment, a case where the water stop structure 100 is applied to the male connector 200 will be described. In the following description, an insertion direction and an extraction direction of the male connector 200 with respect to the female connector 300 are opposite to each other in the shield connector 1. Here, the insertion direction of the male connector 200 with respect to the female connector 300 is referred to as a "connector insertion direction", and the extraction direction of the male connector 200 with respect to the female connector 300 is referred to as a "connector extraction direction". In addition, when both directions are not specified, they are referred to as a "connector insertion and extraction direction".

As illustrated in FIGS. 1 and 2, the water stop structure 100 of the shield connector 1 according to the present embodiment includes an electric wire 2, a rear holder 3, a housing 4, a shield shell 5, a braided body 6, a shield ring 7, a tape 8, and a rubber stopper 9.

A terminal which is electrically connected to a terminal of the female connector 300 side is crimped at an end of the electric wire 2. The terminal is made of a conductive metal material. The electric wire 2 includes a conductive core wire formed of a plurality of strands, and an insulating covering which covers the outer circumferential side of the core wire. In the present embodiment, two electric wires 2 are assembled to the housing 4 as constituent members of the shield connector 1.

The rear holder 3 is an electric wire holding member which is made of insulating synthetic resin or the like to hold a plurality of electric wires 2 in an inserted state. The rear holder 3 has two electric wire holding holes 3*c* penetrating in parallel in the connector insertion and extraction direction. The rear holder 3 includes a main body 3A and a protrusion 3B. The main body 3A is a portion that is disposed in a position facing the inner circumferential surface of the end portion of the shield shell 5 in the connector extraction direction. The main body 3A has a space 3*a* which accommodates an inner circumferential wall 4*a* extending in the connector extraction direction from the housing 4 inside. The main body 3A is held by locking a locking claw (not illustrated) in a locking hole (not illustrated) provided on the inner circumferential wall 4*a* accommodated in the space 3*a*. The protrusion 3B is a portion formed to protrude from the main body 3A along the electric wire 2 in the connector extraction direction, between the electric wire 2 and the braided body 6. The protrusion 3B has an inclined surface 3*b*, as the outer circumferential surface, which is inclined to expand from the end portion in the connector extraction direction toward the connector insertion direction. The inclined surface 3*b* is inclined to expand from the opening of the electric wire holding hole 3*c* in the connector extraction direction toward the connector insertion direction. The braided body 6 is disposed to cover the inclined surface 3*b* from the end portion in the connector extraction direction to the end portion in the connector extraction direction on the outer circumferential surface.

The rear holder 3 is formed such that an end portion 3*d* of the main body 3A in the connector extraction direction is located on diameter reduction side than an end portion 3*e* of the inclined surface 3*b* in the connector insertion direction. As used herein, for example, when the cross-sectional shapes, orthogonal to the connector insertion and extraction direction, of the end portion 3*d* of the main body 3A in the connector extraction direction and the end portion 3*e* of the inclined surface 3*b* in the connector insertion direction are similar long hole shapes, the diameter reduction direction refers to a direction toward the center of the long hole shape. A step 3*f* is formed at the end portion 3*d* of the main body 3A in the connector extraction direction and the end portion 3*e* of the inclined surface 3*b* in the connector insertion direction to make one round in the circumferential direction. The step 3*f* is formed such that the end portion 3*e* of the inclined surface 3*b* in the connector insertion direction is higher than the end portion 3*d* of the main body 3A in the connector extraction direction from the inside toward the outside in the direction orthogonal to the connector insertion and extraction direction. The height of the step 3*f* is preferably set, for example, such that, when the shield ring 7 is attached in a state in which the end portion of the shield shell 5 in the connector extraction direction and the braided body 6 are laminated on the outer circumferential surface of the main body 3A, the shield ring 7 is not extracted toward the connector extraction direction side beyond the step 3*f* covered by the braided body 6.

The housing 4 is made of an insulating material such as a synthetic resin. The housing 4 in the present embodiment holds the electric wire 2 including terminals inside, and locks the rear holder 3 at the end portion in the connector insertion direction. Specifically, the housing 4 is configured to include an inner circumferential wall 4*a*, an outer circumferential wall 4*b*, a space 4*c* provided between the inner circumferential wall 4*a* and the outer circumferential wall 4*b*, and a space 4*d* provided between the inner circumferential wall 4*a* and the outer circumferential surface of the electric wire 2. An end portion of the inner circumferential wall 4*a* in the connector extraction direction is accommodated in the space 3*a* of the rear holder 3, and a locking hole is locked to the locking claw of the main body 3A. The outer circumferential wall 4*b* holds the shield shell 5 inscribed in the inner circumferential surface of the outer circumferential wall 4*b*. In the space 4*c*, a part of the main body 3A of the rear holder 3 and the shield shell 5 are accommodated. In the space 4*d*, a part of the main body 3A of the rear holder 3, a rubber stopper 9 to be described later, and a part of the electric wire 2 including terminals are accommodated.

The shield shell 5 is formed into a tubular shape with a conductive material such as metal. A part of the electric wire 2 including a terminal and a rubber stopper 9 are accommodated inside the shield shell 5. A part of the shield shell 5 in the connector insertion direction is embedded in the housing 4. In the shield shell 5, the main body 3A of the rear holder 3 is disposed on the inner circumferential side of the end portion in the connector extraction direction. In the shield shell 5 in this embodiment, a part of the electric wire 2 including the terminal is accommodated inside, a part of the shield shell 5 on the connector insertion direction side is embedded in the housing 4, and a part of the rear holder 3 is disposed on the inner circumferential side in the connector extraction direction opposite to the connector insertion direction.

The braided body 6 is braided in a tubular shape with a conductive material such as metal. A part of the electric wire 2 including a terminal is disposed inside the braided body 6, and the braided body 6 is electrically connected to the shield shell 5. The braided body 6 has a connecting part 10 in which the inner circumferential surface of the end portion in the connector insertion direction and the outer circumferential surface of the end portion of the shield shell 5 in the connector extraction direction are in contact and electrically connected to each other. The braided body 6 in the present embodiment covers the two electric wires 2 and is disposed to cover the inclined surface 3*b* of the rear holder 3 such that the end portion in the connector insertion direction reaches the connecting part 10.

The shield ring 7 is composed of an annular metallic metal tie or a crimp ring. The shield ring 7 fixes the connecting part 10, in which the shield shell 5 and the braided body 6 are connected to each other, in the diameter reduction direction from the outer circumferential side.

The tape 8 includes a self-adhesive tape made of butyl rubber having insulating properties. The tape 8 is a water blocking member which suppresses entry of water into the interior of the housing 4 and the shield shell 5. The tape 8 in this embodiment is wrapped around the braided body 6 in a spiral shape to cover at least the portion between the end portion of the protrusion 3B in the connector extraction direction and the connecting part 10. The tape 8 is wound, for example, by a half wrap by the hand of the operator.

The rubber stopper 9 is made of an elastically deformable elastic material such as rubber or elastomer. The rubber stopper 9 holds the electric wire 2 in the inserted state. The rubber stopper 9 is inserted into the space 4*c* of the housing 4 in a state in which the electric wire 2 is inserted. By inserting the rubber stopper 9 into the space 4*c*, the outer circumferential surface of the rubber stopper 9 on which the plurality of lips is formed is brought into close contact with the inner circumferential wall 4*a* of the housing 4, and by bringing the inner circumferential surface thereof into close contact with the outer circumferential surface of the electric wire 2, the rubber stopper 9 functions as a water blocking member that prevents water from entering the terminal side, that is, the connector insertion direction side along the electric wire 2.

In the water stop structure 100 of the shield connector 1 according to the above embodiment, the tape 8 is spirally wound to cover the outlet portion of the shield connector 1 for the electric wire 2. The outlet portion for the electric wire 2 in the shield connector 1 includes a range from the rear end of the housing 4 to the electric wire 2, and includes at least a range from an end portion of the rear holder 3 in the connector extraction direction to the connecting part 10. That is, in the water stop structure 100 of the shield connector 1, the tape 8 is wrapped around the braided body 6 in a spiral shape to cover at least from the end portion of the rear holder 3 in the connector extraction direction to the connecting part 10 in which the shield shell 5 and the braided body 6 are connected to each other. As a result, it is possible to obtain the same waterproof effect as in a case where the boot made of rubber is covered at the outlet portion for the electric wire 2 in the shield connector 1. As a result, it is possible to assemble the water blocking member and to improve the assembling workability of the water blocking member, without the operation of expanding the opening of the boot made of rubber to assemble the boot to the shield connector 1.

Further, in the water stop structure 100 of the shield connector 1 according to the above embodiment, the rear holder 3 has an inclined surface 3*b* which is inclined to expand from the end portion in the connector extraction direction toward the end portion of the shield shell 5 in the connector extraction direction. Accordingly, when the tape 8 is wrapped around the shield connector 1, the tape 8 can be wrapped around the braided body 6 on the stable inclined surface 3*b*, rather than on the space. Accordingly, the assembling workability of the water blocking member can be improved.

In the water stop structure 100 of the shield connector 1 according to the above embodiment, the rear holder 3 is formed such that the end portion 3*d* of the main body 3A in the connector extraction direction is located on the diameter reduction side than the end portion 3*e* of the inclined surface 3*b* in the connector insertion direction. That is, the step 3*f* is formed in the rear holder 3 between the end portion 3*d* of the main body 3A in the connector extraction direction and the end portion 3*e* of the inclined surface 3*b* in the connector insertion direction to make one round in the circumferential direction. As a result, for example, even when the braided body 6 is pulled toward the connector extraction direction at the time of the operation of wrapping the tape 8 on the inclined surface 3*b*, the shield ring 7 around the braided body 6 can prevent the braided body 6 from falling off toward the connector extraction direction by abutting the step 3*f*. Furthermore, it is possible to prevent the braided body 6 from being caught by the corner portion of the shield ring 7 and torn in a situation in which the braided body 6 being pulled at the time of the wrapping operation of the tape 8.

The water stop structure 100 of the aforementioned shield connector 1 includes at least one electric wire 2 to which a terminal is crimped at one end; a rear holder 3 which holds the electric wire 2 in an inserted state; a housing 4 which holds the electric wire 2 on an inner side and locks the rear holder 3 at the end portion in the connector insertion direction; a shield shell 5 in which a part of the electric wire 2 is accommodated therein, a part in the connector insertion direction side is embedded in the housing 4, and a part of the rear holder 3 is accommodated on the inner circumferential side in the connector extraction direction opposite to the connector insertion direction; a braided body 6 in which a part of the electric wire 2 is accommodated inside and which is electrically connected to the shield shell 5; a shield ring 7 which fixes the connecting part 10, in which the shield shell 5 and the braided body 6 are connected to each other, from the outer circumferential side in the diameter reduction direction; and a tape 8 which prevents entry of water to the inner side of the housing 4 and the shield shell 5. The rear holder 3 includes a main body 3A disposed at a position facing the inner circumferential surface of the end portion of the shield shell 5 in the connector extraction direction, and a protrusion 3B formed to protrude from the main body 3A along the electric wire 2 in the connector extraction direction between the electric wire 2 and the braided body 6. The braided body 6 is disposed to cover the inclined surface 3*b* which is the outer circumferential surface of the protrusion 3B such that the end portion in the connector insertion direction reaches the connecting part 10. The tape 8 is wrapped around the braided body 6 in a spiral shape to cover at least the portion from the end portion of the protrusion 3B in the connector extraction direction to the connecting part 10. Accordingly, it is possible to obtain the same waterproof effect as in a case where the boot made of rubber is covered at the outlet portion for the electric wire 2 in the shield connector 1. As a result, it is possible to assemble the water blocking member and to improve the assembling workability of the water blocking member, without performing the operation of expanding the opening portion of the boot made of rubber to assemble the boot to the shield connector 1.

Further, according to the water stop structure 100 of the aforementioned shield connector 1, since it is not necessary to provide a shield ring for fixing the boot made of rubber from the outer circumferential side in the diameter reduction direction, it is possible to reduce the number of components.

Further, in the aforementioned water stop structure 100 of the shield connector 1, the rear holder 3 has an inclined surface 3*b* inclined to extend from the end portion of the protrusion 3B in the connector extraction direction toward the connector insertion direction, as the outer circumferential surface of the protrusion 3B. Accordingly, when the tape 8 is wrapped around the shield connector 1, since the tape 8 can be wrapped around the braided body 6 on the stable inclined surface 3*b*, rather than on the space, the assembling workability of the water stop member can be improved.

In the aforementioned water stop structure 100 of the shield connector 1, the rear holder 3 is formed such that the end portion 3*d* of the main body 3A in the connector extraction direction is located on the diameter reduction side than the end portion 3*e* of the inclined surface 3*b* in the connector insertion direction. The shield ring 7 is disposed on the connector insertion direction side from the end portion 3*e* of the inclined surface 3*b* in the connector insertion direction. As a result, for example, even when the braided body 6 is pulled toward the connector extraction direction at the time of the operation of wrapping the tape 8 on the inclined surface 3*b*, the shield ring 7 around the braided body 6 can come into contact with the end portion 3*e* side of the inclined surface 3*b* in the connector insertion direction and prevent the braided body 6 from falling off in the connector extraction direction. Furthermore, it is possible to prevent the braided body 6 from being caught by the corner portion of the shield ring 7 and torn in a situation in which the braided body 6 being pulled at the time of the wrapping operation of the tape 8.

Modified Example

Further, in the above description, although the multi-core shielded cable is used in the water stop structure 100 of the shield connector 1, the present invention is not limited thereto, and the water stop structure 100 may be a single-core shielded cable.

In the above description, a case where the water stop structure 100 of the shield connector 1 is applied to the male connector 200 has been described, but the water stop structure 100 may be applied to the female connector 300. Further, a counterpart component to which the male connector 200 is connected is not limited to the female connector 300, and may be, for example, an electronic device or the like.

Further, in the above description, the rear holder 3 may have a structure in which a space (cavity) is provided between the inclined surface 3*b* and the inner circumferential surface of the protrusion 3B. Further, the rear holder 3 may be a structure that is divided into a direction orthogonal to the arrangement direction of the two electric wires 2 as the direction orthogonal to the connector insertion and extraction direction, in order to set the electric wire 2 in the electric wire holding hole 3*c* in the inserted state.

In the water stop structure of the shield connector according to the embodiment, since the water blocking member is spirally wound to cover the outlet portion of the shield connector for the electric wire, it is possible to assemble the water blocking member without performing an operation of expanding the opening portion of the boot made of rubber to assemble the boot to the shield connector and therefore the assembling workability of the water blocking member is improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A water stop structure of a shield connector, comprising:

at least one electric wire to which a terminal is crimped at one end;

an electric wire holding member holding the electric wire in an inserted state;

a housing made of an insulating material, the housing holding the electric wire including the terminal on an inner side, and the housing locking the electric wire holding member at an end portion in a connector insertion direction;

a tubular shield shell in which a part of the electric wire including the terminal is accommodated on an inner side, a part of the shield shell on the connector insertion direction side is embedded in the housing, and a part of the electric wire holding member is accommodated on the inner side in a connector extraction direction opposite to the connector insertion direction;

a tubular braided body in which a part of the electric wire including the terminal is accommodated on an inner side and which is electrically connected to the shield shell;

a shield ring fixed to a connecting part, in which the shield shell and the braided body are connected to each other, from an outer circumferential side in a diameter reduction direction; and a water blocking member which prevents entry of water to the inner side of the housing and the shield shell, wherein the electric wire holding member includes:

a main body disposed at a position facing the inner circumferential surface of the end portion of the shield shell in the connector extraction direction, and a protrusion formed to protrude from the main body along the electric wire in the connector extraction direction between the electric wire and the braided body, the braided body is disposed to cover the outer circumferential surface of the protrusion, such that the end portion of the braided body in the connector insertion direction reaches the connecting part, and the water blocking member is wrapped around the braided body in a spiral shape to cover at least from the end portion of the protrusion in the connector extraction direction to the connecting part.

2. The water stop structure of the shield connector according to claim 1, wherein the electric wire holding member further has an inclined surface which is inclined to extend from the end portion of the protrusion in the connector extraction direction toward the connector insertion direction, as the outer circumferential surface of the protrusion.

3. The water stop structure of the shield connector according to claim 2, wherein the electric wire holding member is formed such that the end portion of the main body in the connector extraction direction is located on diameter reduction side than the end portion of the inclined surface in the connector insertion direction, and the shield ring is disposed on the connector insertion direction side than the end portion of the inclined surface in the connector insertion direction.

* * * * *